US007028543B2

(12) United States Patent
Hardage et al.

(10) Patent No.: US 7,028,543 B2
(45) Date of Patent: Apr. 18, 2006

(54) SYSTEM AND METHOD FOR MONITORING PERFORMANCE OF DOWNHOLE EQUIPMENT USING FIBER OPTIC BASED SENSORS

(75) Inventors: Bob A. Hardage, Burnet, TX (US); John L. Maida, Jr., Houston, TX (US); Espen S. Johansen, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 223 days.

(21) Appl. No.: 10/348,445

(22) Filed: Jan. 21, 2003

(65) Prior Publication Data

US 2004/0141420 A1 Jul. 22, 2004

(51) Int. Cl.
*E21B 47/00* (2006.01)

(52) U.S. Cl. ..... 73/152.01

(58) Field of Classification Search ..... 73/152.01; 367/25

See application file for complete search history.

(56) References Cited

U.S. PATENT DOCUMENTS

| | | | | |
|---|---|---|---|---|
| 4,030,064 | A * | 6/1977 | Elliott | 367/69 |
| 5,371,330 | A * | 12/1994 | Winbow | 181/106 |
| 5,394,377 | A | 2/1995 | VonBieren | |
| 5,401,956 | A | 3/1995 | Dunphy et al. | |
| 5,499,533 | A | 3/1996 | Miller et al. | |
| 5,539,375 | A | 7/1996 | Atherton | |
| 5,625,716 | A | 4/1997 | Borg | |
| 5,625,724 | A | 4/1997 | Frederick et al. | |
| 5,804,713 | A * | 9/1998 | Kluth | 73/152.01 |
| 5,892,860 | A | 4/1999 | Maron et al. | |
| 6,167,965 | B1 | 1/2001 | Bearden et al. | |
| 6,268,911 | B1 | 7/2001 | Tubel et al. | |
| 6,289,143 | B1 | 9/2001 | Berthold et al. | |
| 6,354,147 | B1 * | 3/2002 | Gysling et al. | 73/61.79 |
| 6,442,506 | B1 | 8/2002 | Trevino | |
| 6,463,431 | B1 | 10/2002 | Schmitt | |
| 6,501,067 | B1 | 12/2002 | Jones et al. | |
| 6,575,033 | B1 | 6/2003 | Knudsen et al. | |
| 6,732,575 | B1 * | 5/2004 | Gysling et al. | 73/61.79 |

FOREIGN PATENT DOCUMENTS

GB 2386687 9/2003

OTHER PUBLICATIONS

U.S. Appl. No. 10/115,727. filed Apr. 3, 2002, Gysling et al.
U.S. Appl. No. 09/726,059, filed Nov. 29, 2000, Kersey et al.
U.S. Appl. No. 09/740,760, filed Nov. 29, 2000, Davis et al.

(Continued)

*Primary Examiner*—Hezron Williams
*Assistant Examiner*—Rodney Frank
(74) *Attorney, Agent, or Firm*—Patterson & Sheridan, LLP.

(57) ABSTRACT

A method and system for monitoring the operation of downhole equipment, such as electrical submersible pumps, is disclosed. The method and system rely on the use of coiled fiber optic sensors, such as hydrophones, accelerometers, and/or flow meters. These sensors are either coupled to or placed in proximity to the equipment being monitored. As the sensor is perturbed by acoustic pressure disturbances emitted from the equipment, the length of the sensing coil changes, enabling the creation of a pressure versus time signal. This signal is converted into a frequency spectrum indicative of the acoustics emissions of the equipment, which can then be manually or automatedly monitored to see if the equipment is functioning normally or abnormally, and which allows the operator to take necessary corrective actions.

40 Claims, 4 Drawing Sheets

OTHER PUBLICATIONS

U.S. Appl. No. 10/068,266, filed Feb. 6, 2000, Berg et al.
U.S. Appl. No. 09/410,634, filed Oct. 1, 1999, Knudsen et al.
U.S. Appl. No. 10/266,903, filed Oct. 6, 2002, Berg et al.
Hill, D.J.; Nash, P.J.; Jackson, D.A.; Webb, D.J.; O'Neill, S.F.; Bennion, I.; Zhang, L., "A Fiber Laser Hydrophone Array," *Proc. SPIE* vol. 3860, pp. 55-66, in *Fiber Optic Sensor Technology and Applications,* Marcus, M.A. and Culshaw, B., Eds. (1999).

U.K. Search Report, Application No. GB0400975.9, dated May 27, 2004.

* cited by examiner

SYSTEM AND METHOD FOR MONITORING PERFORMANCE OF DOWNHOLE EQUIPMENT USING FIBER OPTIC BASED SENSORS

FIELD OF THE INVENTION

The present invention relates generally to a system and method for monitoring performance of downhole equipment and, more particularly to a system and method for monitoring changes in the performance of downhole pumps or mechanical production equipment with Fiber Bragg grating hydrophones.

BACKGROUND OF THE INVENTION

Failure of equipment placed downhole in an oil/gas well results in unscheduled downtime, lost production, high repair costs, and potential damage to neighboring equipment. In a typical well, downhole equipment can include electrical submersible pumps (ESP), such as that disclosed in U.S. Pat. No. 6,167,965, as well as rotating machinery, plunger valves, and other types of equipment. Common failure modes of downhole equipment include excessive wear, failure of bearings, dynamic stress, excessive fouling, and impeller damage. Unfortunately, downhole equipment is typically inaccessible during operation, and if a failure occurs there is often no indication of what component has failed. Preventive maintenance can be achieved through monitoring the downhole equipment by sensing acoustic or vibration measurements emanating therefrom. Such monitoring can be used as part of a maintenance schedule to keep equipment operating longer at the least overall cost. Additionally, equipment overhaul can be scheduled in advance with minimum disruption in operation and production.

Electrical systems have been used to monitor the operation of downhole equipment, such as are disclosed in U.S. Pat. Nos. 5,499,533, 5,539,375, and 6,167,965. Typically such systems monitor equipment health by electrically sensing vibration of the equipment, or by monitoring the current that is sent to the equipment to see if these indicia are non-optimal. However, because these systems rely on electronic components, they are susceptible to failure in the harsh downhole environment, which is characterized by extreme pressures, temperatures, and caustic chemicals. The shortcomings of using electrical equipment to monitor downhole equipment are further disclosed in U.S. Pat. No. 5,892,860, which is incorporated herein by reference in its entirety.

By contrast, downhole sensors based on fiber optic technology are highly reliable, and accordingly, have been used in several different ways to monitor various conditions downhole, such as pressures, temperatures, flow rate, phase fractions of the fluid being produced, etc.

A good example of a fiber optic based sensor useable in a downhole environment is a fiber optic based hydrophone. As is well known, a fiber optic hydrophone is a relatively simple device and generally comprises a length of fiber optic cable wound around a compliant mandrel. The length of the cable is perturbed by the force of acoustic pressure on the mandrel. Positioning of fiber Bragg gratings (FBGs) on each end of the length of cable allows the length of the cable, and hence the properties of the acoustic disturbance, to be determined by interferometric means as is well known. Alternatively, the mandrel can comprise a sensing cable wound around a compliant mandrel, and a reference cable wound around a rigid mandrel, a configuration which again allows for a determination of the change in length of the sensing cable. Examples of fiber optic based mandrels are disclosed in U.S. Pat. Nos. 5,394,377, 5,625,724, 5,625,716, and D. J. Hill et al., "A Fiber Laser Hydrophone Array," SPIE Vol. 3860 (1999), which are hereby incorporated by reference in their entireties. Other devices similar in nature to a hydrophone, such as the fiber optic acoustic emission sensor disclosed in U.S. Pat. No. 6,289,143, which is hereby incorporated by reference in its entirety, can likewise be used to sense high frequency vibrations, and is likewise incorporated by reference herein. These prior art approaches rely on several different types of interferometric approaches (e.g., Mach Zehnder, Michaelson, Fabry Perot, ring resonators, polarimetric and two-mode fiber interferometers), and can be interrogated, for example, by the diagnostic system disclosed in U.S. Pat. No. 5,401,956, or U.S. patent application Ser. No. 09/726,059, filed Nov. 29, 2002, which are also incorporated herein by reference in their entireties.

It has been noted that fiber optic sensors, like electronic sensors, can be used to monitor the health of downhole equipment. For example, in U.S. Pat. No. 6,268,911, hereby incorporated by reference in its entirety, it is noted that fiber optic based sensors can be used to monitor the condition or health of downhole equipment, but the type of sensor to be used is not described in detail (see FIG. 11 of the '911 patent and associated text). U.S. Pat. No. 5,892,860, also incorporated herein by reference in its entirety, similarly discloses a fiber optic based sensor for monitoring downhole equipment. In this patent, a sensor structure is disclosed which can be mounted in the casing of an ESP. The disclosed sensor employs a series of three linearly-arranged FBGs serially coupled using a wavelength-division multiplexing (WDM) approach, in which one FBGs acts as a pressure sensor, another as a temperature sensor, and (as most relevant to this disclosure) another as a dynamic sensor (accelerometer) for measuring the vibrations of the ESP. However, a review of this patent reveals a rather complicated sensor structure, as various schemes and components must be used in the sensor housing to allow each of the FBGs to detect the parameter of interest.

Although the disclosure in the '911 patent is rather vague, it is reasonable to conclude that these prior art fiber optic based approaches to monitoring downhole equipment operation present complicated approaches. Additionally, the approach of the '860 patent relies on the sensitivity of a single FBG to detect dynamic variations, which is not as sensitive as the above-discussed hydrophones, which typically employ interferometric approaches capable of detecting and distributing dynamically induced pressures over a substantial length of fiber optic cable. Moreover, the '860 patent only contemplates a direct connection of the sensors to the equipment being measured, which may be unsuitable for applications in which the equipment will not lend itself to such modification. What is needed is an apparatus for detecting the operation of downhole equipment that uses the relatively simple and precise structure of a basic hydrophone or other forms of fiber optic sensors having coils as the acoustic sensing element. This disclosure presents such configurations.

SUMMARY OF THE INVENTION

A method and system for monitoring the operation of downhole equipment, such as electrical submersible pumps, is disclosed. The method and system rely on the use of coiled fiber optic sensors, such as hydrophones, accelerometers, and/or flow meters. These sensors are either coupled to or placed in proximity to the equipment being monitored. As the sensor is perturbed by acoustic pressure disturbances emitted from the equipment, the length of the sensing coil changes, enabling the creation of a pressure versus time signal. This signal is converted into a frequency spectrum indicative of the acoustics emissions of the equipment, which can then be manually or automatedly monitored to see if the equipment is functioning normally or abnormally, and which allows the operator to take necessary corrective actions.

BRIEF DESCRIPTION OF THE DRAWINGS

The foregoing summary and other aspects of the present invention will be best understood with reference to the detailed description of the invention which follows, when read in conjunction with the accompanying drawings, in which.

DETAILED DESCRIPTION OF THE INVENTION

A preferred embodiment for detecting the operational efficiency of downhole equipment utilizes a fiber optic based hydrophone having a sensitive coil of fiber optic cable to measure the acoustic emissions of the equipment. Such sensors preferably utilize fiber Bragg gratings (FBGs) and can measure acoustic signals in a frequency range up to 50 kHz. More generally, a sensor useable with the disclosed equipment-monitoring technique includes any types of fiber optic sensor employing a sensing coil of fiber optic cable, such as the accelerometers or flow meters disclosed and incorporated herein.

Figure 1:
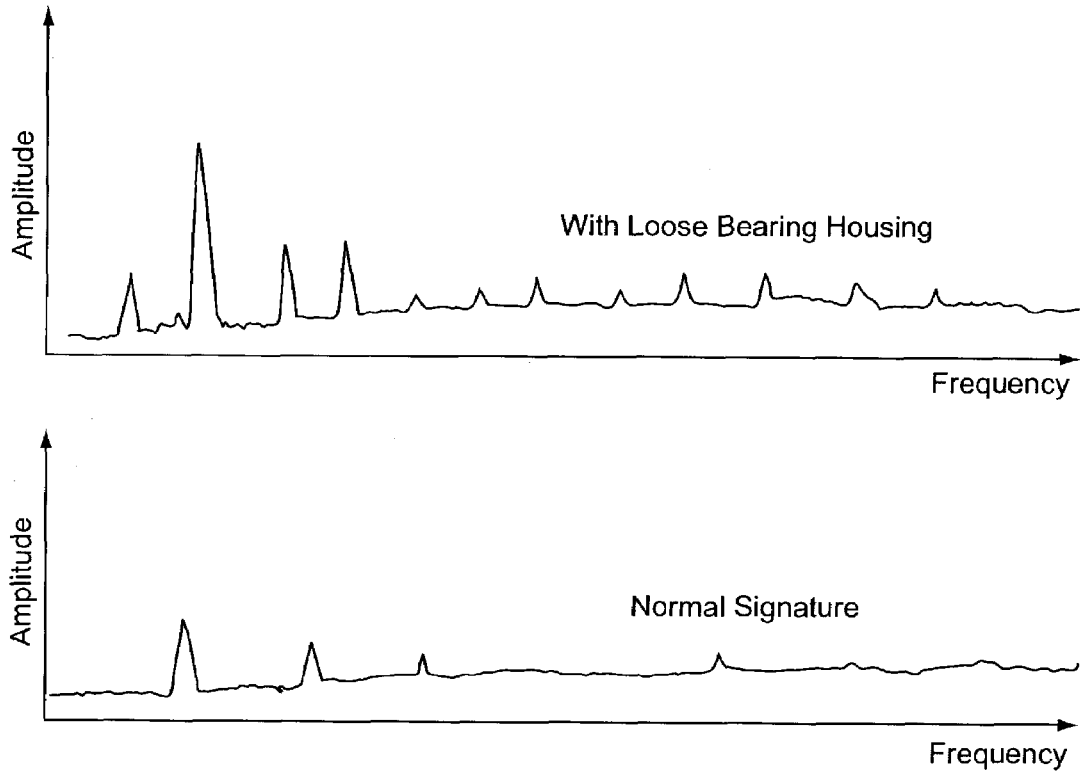
FIG. 1 illustrates exemplary emitted acoustic frequency spectra for a properly functioning downhole piece of equipment and an improperly functioning piece of equipment.

FIG. 1 generally illustrates the utility of and need for equipment monitoring. In FIG. 1, two audio spectra are disclosed for an Electrical Submersible Pump (ESP). The bottom spectrum shows the spectra emitted by an ESP that is functioning properly. As can be seen, this spectrum contains certain resonant peaks that are caused by naturally occurring phenomenon in the pump, and may be caused for example by the impellers in the pump, which rotate at a fixed frequency and therefore emit acoustics at those frequencies and other harmonics thereof. By contrast, the upper frequency spectra shows the spectrum of a pump that is not working properly, for example, because its bearings are loose. The loose bearings will change the frequency spectrum for the pump, and additional peaks or changes in amplitude of peaks can pinpoint the component with degraded performance or failure. Detection of these additional peaks, either by manual or automated means, is the goal that the present disclosure seeks to reach, so that corrective action may be taken by the operator of the downhole equipment before catastrophic failure occurs.

Figure 2:
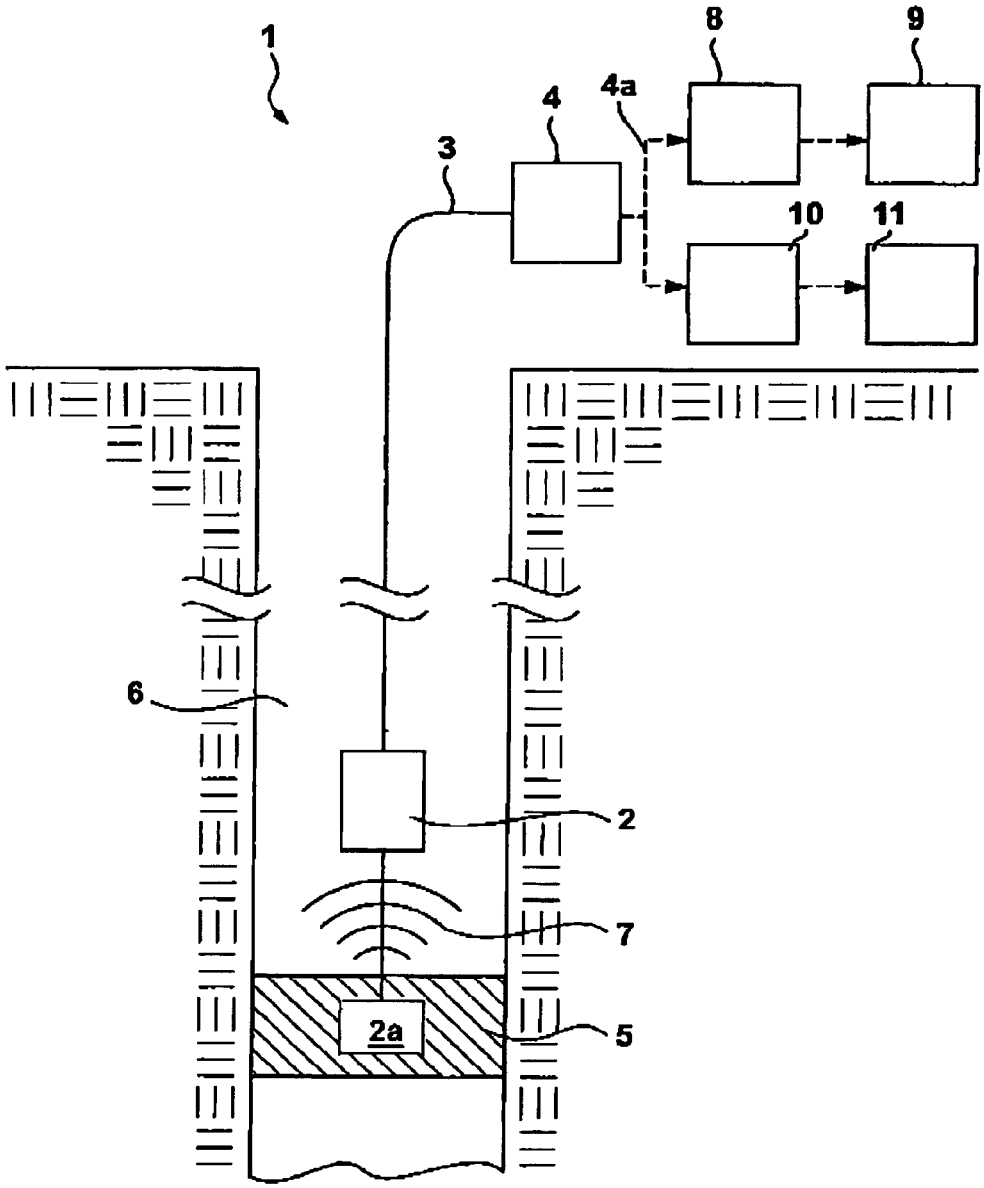
FIG. 2 illustrates an oil/gas well having a borehole and containing a fiber optic based sensor for detecting acoustic emission emanating from a downhole piece of equipment, and further illustrates surface equipment for processing the signals reflected from the sensor and for producing a frequency spectrum of the acoustic emissions.

FIG. 2 schematically illustrates a system for monitoring the condition of downhole equipment using coiled-based fiber optic sensors. The system is applicable to land-based or subsea well completions. The system 1 includes a fiber optic sensor 2, a fiber optic transmission cable 3, and an optical interrogation and signal analysis device 4. The equipment 5 to be monitored (e.g., an ESP) is positioned within a borehole 6, which as is well known is preferably defined by a cemented casing on the edges of the borehole (not shown). The wires to couple power to the equipment 5 are not shown for clarity. As is well known, the completed well would also include a production pipe, also not shown for clarity, and the equipment 5 may be coupled to the production pipe or the casing of the well. The cable 3 used to interrogate the sensor 2 is preferably housed in a protective metallic tubing and affixed to the production pipe, as disclosed in U.S. patent applications Ser. Nos. 09/121,468, filed Jul. 23, 1998, and 09/497,236, filed Feb. 3, 2000, which are incorporated herein by reference in their entireties. The protective tubing can also contain the electrical wires for powering the equipment 5 if desired.

The fiber optic sensor 2 is positioned in the borehole 6 in proximity to the equipment 5 to be monitored, so the sensor 2 can receive acoustic signals 7 from the equipment 5. This receiving of acoustic signals 7 can be accomplished either by directly coupling a sensor 2*a* to the equipment 5 or by placing the sensor 2 in near enough proximity to the equipment that the acoustics emitted therefrom will propagate though the borehole 6 (i.e., through the well fluids or gases) to the sensor 2. When directly coupling the sensor 2 to the equipment, it is preferable to form in the equipment a recess for holding and/or housing the sensor 2, such as is described in the above-referenced U.S. Pat. No. 5,892,860. Alternatively, any well-known means of affixing the sensor 2 to the equipment 5 can be used, such as bolting, banding, clamping, etc.

In those embodiments in which the sensor 2 is not directly coupled to the equipment 5, the sensor should be placed at a suitable distance from the equipment 5 so that its acoustic signature can be reliably determined. For a given application, some amount of routine experimentation may be needed to determine acceptable spacing between the sensor 2 and the equipment 5 so that the (i) the acoustics from the equipment do not saturate the sensor (if the sensor is too close), or (ii) the acoustics are not too attenuated to be discernable (if the sensor is too far). Determination of the correct spacing will therefore depend on a number of factors, such as the power of the acoustics generated by the equipment 5, the sensitivity of the sensor 2, and the level of detectable background noise. If the sensor 2 is remotely located from the equipment 5, it is preferably affixed to the production pipe, again, using any well known means such as bolting, banding, clamping, etc, or by incorporating the sensor 2 within a cylindrical housing formed around or incorporated into the production pipe. Alternatively, the sensor 2 can be affixed to the casing again by well-known means, although in this embodiment care should be taken to provide a suitable protective covering to the sensor so that it will not be damaged by deployment of the production equipment. The sensor 2 may also be left free floating within the production pipe or the annulus, although care should be taken in this case to ensure that the sensor will not be susceptible to damage or to obstructing the well.

The use of dampening members in conjunction with affixation of the disclosed sensors 2 (e.g., spring, elastomers, etc.) can assist in reducing background noises which otherwise might affect the ability of the sensors to detect noise emanating from the equipment 5.

An advantage of using a fiber optic based sensor 2 is that the sensor can easily be multiplexed with other fiber optic based sensors that are used in conjunction with the production equipment. In this regard, one skilled in the art will recognize that several such fiber optic based sensors are known, such as those that measure temperature, pressure, flow rate, phase fraction, etc., and which are disclosed in the following U.S. Patents and/or patent applications, and which are hereby incorporated by reference in their entireties: U.S. Pat. Nos. 6,354,147; 6,452,667; 6,422,084; U.S. patent application Ser. Nos. 10/115,727, filed Apr. 3, 2002; 09/740,760, filed Nov. 29, 2000; 09/726,059, filed Nov. 29, 2000; and 09/494,417, filed Jan. 31, 2000. Integration of the disclosed sensors 2 with these and other fiber optic based sensors can be achieved along a single fiber optic cable, which can be multiplexed using a time-division multiplexing approach, a wavelength-division multiplexing approach, or other known multiplexing techniques or combinations thereof. Indeed, two or more of the sensors disclosed herein can also be multiplexed together to form an array of sensors for detecting acoustic emissions from the equipment 5 (see sensor 2' in FIG. 4).

Figure 4:
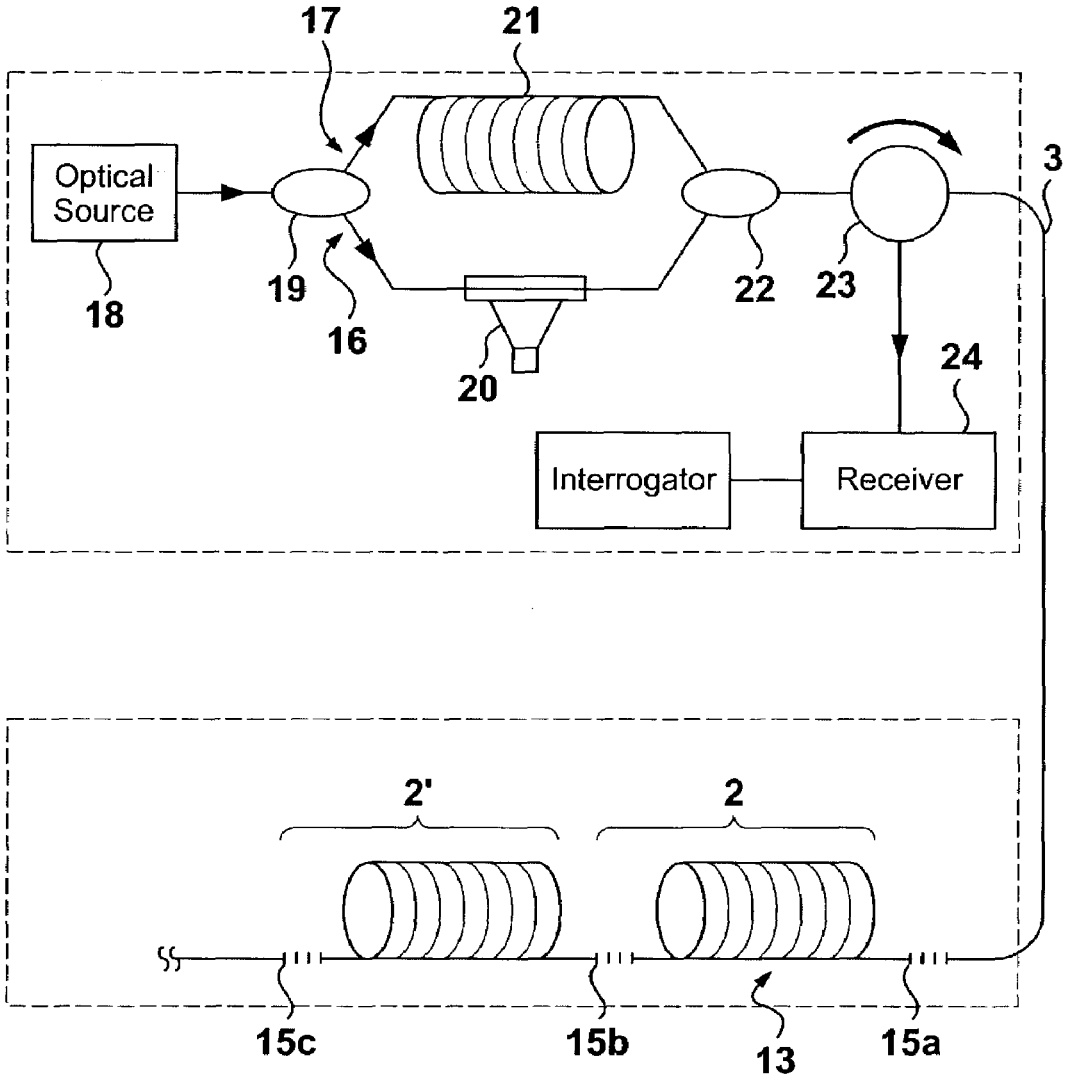
FIG. 4 illustrates a preferred optical source/detection system for interferometrically interrogating the disclosed sensors.

The cable 3 coupled to the sensor 2 is coupled to certain optoelectronic surface equipment, usually residing at the surface of the well. As one skilled in the optical arts will understand, the surface equipment will include suitable light sources (e.g., laser or broadband sources) for interrogating the sensor 2, and will also contain detection equipment (e.g., photodetectors) for receiving signals reflect from the sensor. Such well-known source/detection equipment is not shown in FIG. 2 for clarity, but is shown in FIG. 4 in more detail.

As is particularly relevant to the disclosed embodiments, the surface equipment includes a signal analysis device 4 coupled to the optical detector (not shown), which outputs data 4*a* indicative of a frequency spectrum (see FIG. 1 for example) of the acoustics detected by the sensor 2 as will be explained in further detail later in this disclosure. Data 4*a* is preferably sent along two paths depending on whether manual or automated monitoring of the frequency spectrum is to be utilized. Along the manual monitoring path, the data 4*a* is sent to an audio amplifier 8 and to a listening station 9. As data 4*a* is preferably (but not necessarily) digital in nature, audio amplifier 8 preferably contains suitable processing electronics to convert the digital signals indicative of the frequency spectrum to analog signals. These analog signals are then sent to a suitable listening device at the listening station containing a speaker, e.g., in a pair of headphone or a broadcast speaker. Because the various ways in which digital data may be processed into analog audio signals is well known, further details concerning such processing are not further described. By manually listening to the equipment, an experienced operator, attuned to the sounds of normally functioning equipment, may be able to detect improperly functioning equipment, and take necessary corrective actions as noted earlier.

Along the automated monitoring path, the data 4*a* is sent to a signal processor 10 which is connected to an output device or indicator 11, such as a monitor or printer. The signal processor 10 preferably comprises a personal computer having data recognition algorithms (as is well known) to provide an assessment of the frequency data of data 4*a*. For example, the signal processor 10 can contain a baseline normal frequency spectrum (e.g., FIG. 1, lower spectrum) of the equipment being monitored, which may be determined based upon historical operation of the equipment. The signal processor can compare this baseline spectrum with the measured spectrum to discern the existence of peaks or other abnormalities in the spectrum which may be indicative of problems with the equipment. In fact, experience, logic, or an understanding of the physics of the equipment might teach that certain frequency peaks are indicative of a particular problem with the equipment, e.g., loose bearings, which can be of great value to the operator. The signal processor 10 and/or the output device 11 can constitute, for example, a personal computer.

One skilled in the art will recognize that the surface equipment depicted in FIG. 2 and discussed above can be arranged and/or combined in several ways, and can include a single integrated system capable of both automated and manual monitoring. Alternatively, the system can employ only automated monitoring or manual monitoring.

Figure 3:
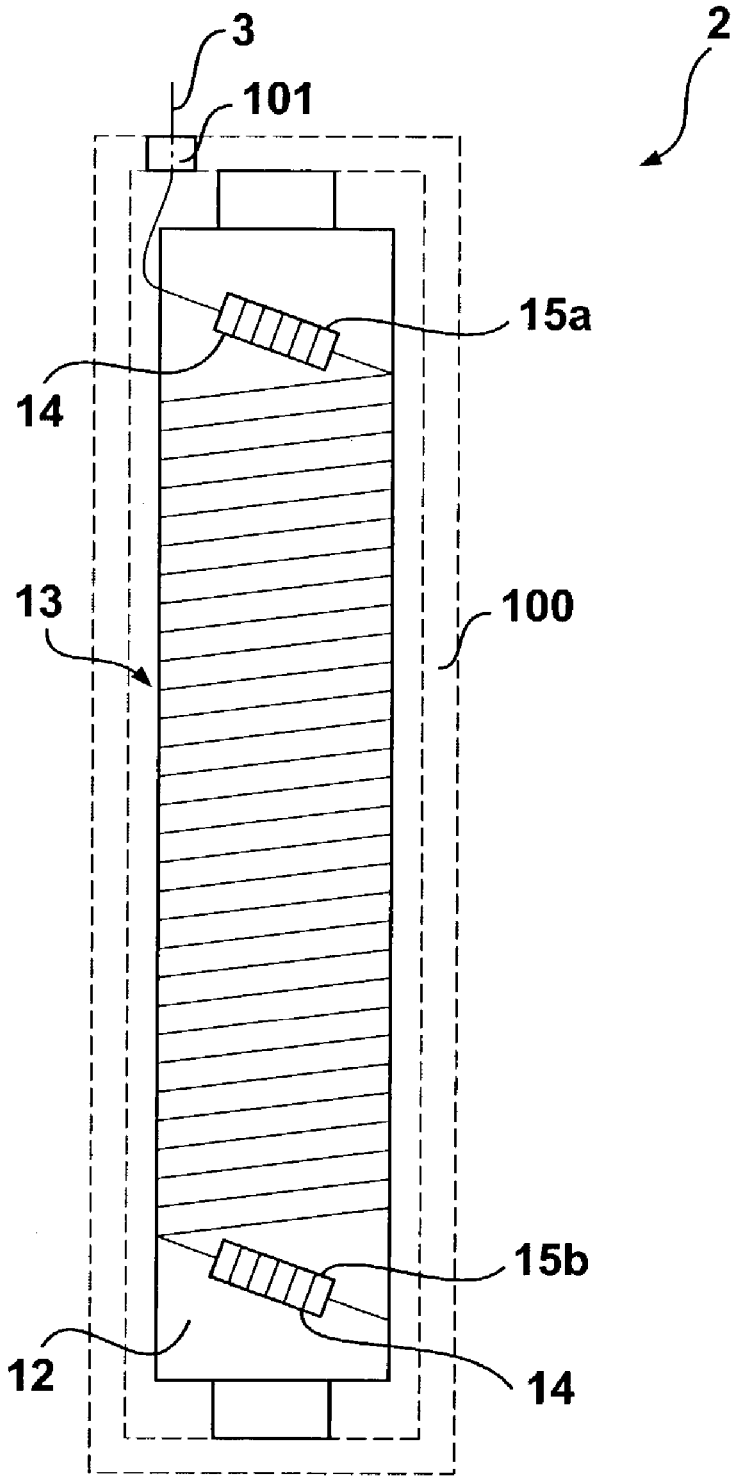
FIG. 3 illustrates an exemplary hydrophone useable as the sensor in the system of FIG. 2.

FIG. 3 shows an example of a fiber optic based sensor 2 to be used in conjunction with the disclosed equipment monitoring application. In a preferred embodiment, the sensor 2 comprises a hydrophone with a coil 13 of fiber optic cable (similar to transmission cable 3) which is wound around a compliant cylindrical mandrel 12. Spliced into the coil at both ends are fiber Bragg gratings (FBGs) 15*a*, 15*b*. In a preferred embodiment, such as that disclosed in U.S. patent application Ser. No. 09/726,059, filed Nov. 29, 2000, which is incorporated herein by reference in its entirety, light pulses are reflected off the FBGs in such a manner that the reflections will overlap along the transmission cable 3. An assessment of the phase shift in the overlapping signals can be used to determine the length of the coil. Because the mandrel 12 is compliant, and preferably hollow, acoustic emissions produced by the equipment being monitored will cause the mandrel to deform, which in turn perturbs the length of the coil. The mandrel 12 is typically from one to nine inches in diameter and from one foot to several feet in length depending on the particular application. Smaller mandrels (e.g., approximately one inch in diameter and three inches in length) can be used in applications where the mandrel must be deployed in a tight space, such as in the annulus of an oil/gas well. The thickness and material of the mandrel will affect its compliancy, and can be set to adjust to sensor's sensitivity and to ensure that the mandrel 12 will not break or corrode when exposed to chemicals and high pressure or temperatures present within the well. As previously mentioned, the mandrel 12 is preferably hollow, and may be pressurized to help tune the responsiveness of the mandrel 12 in light of the pressures the mandrel will see in its expected operating environment.

Coil 13 is preferably tightly coiled around the mandrel 12 such that the coil is intimately connected with the mandrel 12 structure. Tight coiling also minimizes the axial component of each turn of the coil 13, which effectively keeps each turn to a known, constant length. A coil 13 can consist of a single layer of optical fiber turns or multiple layers of optical fiber. The sensor coil 13 may be attached to the mandrel 12 by a variety of attachment mechanisms including, but not limited to, adhesive, glue, epoxy, or tape. In a preferred embodiment, a layer of epoxy surrounds the fiber coil 13 to protect it from the outer environment and to maintain the attachment of the sensor coil 13 to the mandrel 12. One skilled in the art will recognize that the number of coils can be optimized for mandrel size and sensitivity, and therefore may vary depending on the application at hand. Because each turn increases the effective optical length of the coil 13, the coil's sensitivity scales with the number of turns in the coil. A length of the coil 13 between the FBGs 15*a*, 15*b* on the order of tens of feet should create a sensor of suitable sensitivity, and hence for a small mandrel (e.g., one inch in diameter), a coil 13 of 50 to 300 turns is expected to be sufficient, but smaller or larger lengths could be used. Moreover, shorter lengths for the coil 13 can be used if the coil is interrogated not with discrete pulses but in a continuous wave fashion, and if this interrogation scheme is used the reflection wavelengths for the FBGs 15*a*, 15*b* would preferably be different, what is known as a wavelength division multiplexed approach.

It is preferable to place an isolation pad 14 between the FBGs 15*a*, 15*b* and the outer surface of the mandrel 12 to isolate the FBGs from the mechanical strain on the mandrel 12. Such an isolation pad 14 is disclosed in U.S. patent application Ser. No. 09/726,060, filed on Nov. 29, 2000, which is incorporated herein by reference in its entirety.

In some applications, it may not be preferable to directly expose the coil 13 (or the adhesive applied thereto) to the harsh downhole environment. Accordingly, and as shown in FIG. 3, the mandrel 12 may be placed inside a housing 100. In this embodiment, the housing is preferable filled with, for example, silicone oil that allows the acoustics from the equipment to couple through to the coil 13. In this regard, it is preferred that the housing be flexible to allow acoustics outside of the housing 100 to couple through to the coil 13. The housing may made of the same material as the mandrel, e.g., Inconel. If necessary, the housing may include additional structures (not shown) to facilitate its connection to the production pipe, casing, or the equipment 5 to be monitored, such as threads, slots for meeting with bands or clamps, bolt hole landings, etc. The fiber optic cable 3 may pass out of one or both ends of the housing via a fiber optical feedthrough 101, many of which are known in the art. For pressure compensation, it may be preferable to provide a small amount of air or other gas, or a gas filled bladder, in the silicone oil to relieve hydrostatic pressure that otherwise might be presented to the hydrophone when it is deployed in a well. In this regard, one skilled in the art will realize that the gas in the silicone oil is preferably nonvanishing and remains undissolved in the oil even when subjected to the pressure and temperatures expect in the hydrophone's operating environment.

The disclosed hydrophone of FIG. 3 is merely exemplary, and other hydrophone designs will have applicability to the disclosed technique for equipment monitoring. Another hydrophone design useable in this context is disclosed in U.S. patent application Ser. No. 10/266,903, filed Oct. 6, 2002, which is hereby incorporated by reference.

Other types of fiber optic sensing devices containing interferometrically-interrogated coils may also be used to sense acoustic emissions of the downhole equipment as disclosed herein, and the use of a hydrophone should only be understood as exemplary. For example, fiber optic accelerometers, such as those disclosed in U.S. patent applications Ser. Nos. 09/410,634, filed Oct. 1, 1999, and 10/068,266, filed Feb. 6, 2002, which are both incorporated by reference in their entireties, may also be used in lieu of the disclosed hydrophone with similar effect. These references disclose axially sensitive accelerometers, which are either sensitive in a direction parallel or perpendicular to the housing. In each reference, a housing contains coils of fiber optic cable coupled to mass, which moves within the housing in response to an accelerative force, such as would be formed by the acoustic emission of the equipment being monitored. Depending on the application at hand, these axially sensitive types of coiled sensors can be useful in distinguishing the direction of the acoustic vibrations emitted by the equipment being monitored, which can be useful if a more sophisticated or "3-D" acoustic signature is desirable or helpful to characterize the operation of the equipment. A method of housing coiled fiber optic based accelerometers to detect acoustics along three orthogonal directions is disclosed in U.S. patent application Ser. No. 10/266,903, filed Oct. 6, 2002, which is hereby incorporated by reference herein. Other types of coiled and interferometrically-interrogated fiber optic sensors may be used to sense the acoustics emitted by the equipment 5. For example, U.S. patent application Ser. Nos. 09/740,760, filed Nov. 29, 2000, 10/115,727, filed Apr. 3, 2002, and U.S. Pat. No. 6,354,147, which are incorporated by reference herein in their entireties and are hereinafter referred to as the "flow meter references," disclose flow meters capable of detecting, amongst other things, the acoustic emission from a piece of equipment being monitored. The stated purposes of these flow meter references are to provide flow meters capable of detecting acoustics within the production pipe, which can enable the operator to detect certain parameters about the fluid flowing through the production pipe. The flow meter references, for example, allow for the detection of acoustics or pressure perturbations within the fluid in the production pipe that travel at the speed of sound in the fluid and at the fluid's flow rate to determine such parameters as the fluid flow rate, the density of the fluid, its phase fractions, etc. The flow meter consists of a series of fiber optic coils placed at certain axial locations along the outside of the production pipe, with each being bounded by a pair of FBGs. Any one coil in these flow meter references is hence effectively no different from the coiled hydrophones or accelerometers disclosed or incorporated into this disclosure. Accordingly, these coils in the flow meter will also detect acoustics emitted from the equipment if placed in reasonable proximity thereto.

When a coil in a flow meter is used as the sensor to detect acoustic emissions from a piece of equipment, the acoustic coupling of the emissions will likely proceed through the fluid within the production pipe. This occurs because a traditional flow meter, such as those disclosed in the above-incorporated flow meter references, typically employ a gas or vacuum backed housing surrounding the coils that surround the production pipe. In a traditional flow meter application, such gas backing assists in isolating external downhole noises not related to fluid flow within the production pipe. However, to the extent that a flow meter is to be additionally used to monitor equipment as disclosed herein, it might be advantageous to fill the flow meter's housing with silicone oil to improve the coupling to the sensor coils around the production pipe. Or, the housing could be designed to be half-filled with oil and half gas backed, with coils appearing within the oil being used primarily for equipment monitoring, and coils appearing within the gas backing being used primarily for production flow monitoring.

In a particular application, the ability of the flow meter to sense both produced fluid parameters and the acoustic emissions from a piece of downhole equipment potentially provides value to the operator, who can simplify the downhole tooling by using a single and versatile fiber optic tool. Of course, in this application, care will need to be taken to discriminate flow noise within the production pipe from equipment noise. Such discrimination is possible because the frequency of flow noise is broadband in nature, while the frequency emitted by the equipment is typically narrow band, showing up as sharp peaks. Accordingly, and understanding the physics at issue, the operator should be able to assess either certain higher frequency ranges and/or stationary peaks to understand the condition of the equipment while simultaneous assessing flow noise. If necessary, a high pass filter can be associated with the signal analysis device 4. However, it should also be noted that the equipment would not necessarily be deleterious to the operation of the flow meter to detect flow noise, as the vibration of the equipment can act to add acoustics to the flowing fluids that may facilitate operation of the flow meter.

As noted earlier, coiled sensors, such as are found in the disclosed hydrophone and the above-incorporated accelerometers and flow meters, are superior to prior art approaches relying on the straining of individualized FBGs because they are generally more sensitive, their sensitivities can be tailored by adjusting the coil length, and are subject to interferometric interrogation.

As noted, the sensors disclosed herein, be they hydrophones, accelerometers, or flow meters, can be interrogated by interferometric means, as is disclosed in U.S. patent application Ser. No. 09/726,059, filed Nov. 29, 2000, which is incorporated herein by reference in its entirety. Briefly explained, and referring to FIG. 4, the FBGs 15*a*, 15*b* that bracket the coil 13 of the sensor 2 are interrogated by a series of pulses emitted from optical source 18. These pulses are split in two by an optical coupler 19, and one of the two split pulses is passed through a delay coil 21. A modulator 20 provided modulation to other split pulse. These pulses are then combined at coupler 22 and directed via optical circulator 23 onto fiber optic cable 3. In a preferred embodiment, the time-of-flight through the delay coil 21, and the duration of the pulses emitted from the optical course 18, equal the double-pass time-of flight of the coil 13 that comprises the sensor 2. This provides a non-delayed and a delayed pulse to the cable 3 which generally abut each other in time. Because the FBGs are of relatively low reflectivity, the first (non delayed) pulse will reflect off of the second FBG 15*b* and appear at the first FBG 15*a* at the same time that the second (delayed) pulse reflects from the first FBG 15*a*. This causes the reflected signals to combine, and interfere, on cable 3. As is well known, by assessing the phase shift within the interfering reflected pulses, the length of the coil, and hence its degree of stress, can be determined by receiver 24 and the interrogator as is well known.

As noted previously, the signal analysis device 4 (FIG. 2) converts the raw signals reflected from the sensor into a frequency spectrum, represented in FIG. 2 as data 4*a*. Because such a conversion process is well known to those in the signal processing arts, the process for creating the frequency spectrum is only briefly described. As is known, and assuming a suitably high optical pulse (sampling) rate, the reflected signals from the sensor 2 will initially constitute data reflective of the acoustic pressure presented to the sensor 2 by the equipment 5 as a function of time. This pressure versus time data is then transformed by the signal analysis device 4 to provide, for some sampled period, a spectrum of amplitude versus frequency, as is shown in FIG. 1. As is well known, this can be achieved through the use of a Fourier transform, although other transforms, and particularly those applicable to processing of discrete or digitized data constructs, may also be used. While the disclosed sensors are sensitive in frequency up to 50 kHz, and particular over the range of frequencies detectable by the human ear, one skilled in the art will recognize that suitably short sampling periods may be necessary to resolve an frequency range of interest.

As used in this disclosure, the term "coupled" should not be understood as necessarily indicative of direct contact. Two items can, depending on the circumstances, be said to be coupled in a functional sense even if some structure intervenes between the two.

While the invention has been described with reference to the preferred embodiments, modifications and alterations are possible. It is intended that the invention include all such modifications and alterations to the extent that they come within the scope of the following claims or constitute equivalents thereof.

What is claimed is:

1. A system for monitoring the operation of a piece of equipment positioned within a well, comprising:

a fiber optic based sensor, wherein the sensor comprises at least one coil sensitive to acoustic emissions of the equipment caused by mechanical operations of the equipment, and wherein the sensor is directly affixed to the piece of equipment;

a signal analyzer coupled to the sensor by a fiber optic transmission line, wherein the signal analyzer converts reflections from the sensor into data, wherein the data is indicative of a frequency spectrum of the acoustic emissions; and a signal processor for receiving the frequency spectrum data and performing an automated analysis on the data to assess the operation of the equipment.

2. The system of claim 1, wherein the sensor comprises a hydrophone.

3. The system of claim 1, wherein the sensor comprises an accelerometer.

4. The system of claim 1, wherein the sensor is interferometrically interrogated.

5. The system of claim 1, wherein the sensor comprises a compliant mandrel, and wherein the coil is wound around the mandrel.

6. The system of claim 5, wherein the mandrel is cylindrical.

7. The system of claim 5, wherein the mandrel is hollow.

8. The system of claim 5, wherein the mandrel is enclosed in a housing.

9. The system of claim 8, wherein the housing is filled with a liquid.

10. The system of claim 1, further comprising a speaker for broadcasting the frequency spectrum data to an operator.

11. The system of claim 1, wherein the coil is bound by reflectors.

12. The system of claim 11, wherein the reflectors comprise fiber Bragg gratings.

13. A system for monitoring the operation of a piece of equipment positioned within a well, comprising:

a fiber optic based sensor, wherein the sensor comprises at least one coil sensitive to acoustic emissions of the equipment caused by mechanical operations of the equipment, wherein the coil is bounded by a pair of reflectors, and wherein the sensor is placed within the well in proximity to the piece of equipment;

optical source and detection equipment for interferometrically interrogating the sensor and receiving reflected signals;

a signal analyzer coupled to the optical source and detection equipment to create a data set from reflected signals, wherein the data set is indicative of a frequency spectrum of the acoustic emission; and a signal processor for receiving the frequency spectrum data and performing an automated analysis on the data to assess the operation of the equipment.

14. The system of claim 13, wherein the sensor comprises a hydrophone.

15. The system of claim 13, wherein the sensor comprises an accelerometer.

16. The system of claim 13, further comprising a production pipe, and wherein the coil is wrapped around the production pipe.

17. The system of claim 13, wherein the sensor comprises a compliant mandrel, and wherein the coil is wound around the mandrel.

18. The system of claim 17, wherein the mandrel is cylindrical.

19. The system of claim 17, wherein the mandrel is hollow.

20. The system of claim 17, wherein the mandrel is enclosed in a housing.

21. The system of claim 20, wherein the housing is filled with a liquid.

22. The system of claim 13, further comprising a speaker for broadcasting the frequency spectrum data to an operator.

23. The system of claim 13, wherein the reflectors comprise fiber Bragg gratings.

24. The system of claim 13, wherein the sensor is affixed to a production pipe within the well.

25. The system of claim 13, wherein the sensor is affixed to a casing within the well.

26. A method for monitoring the operation of a piece of equipment positioned within a well, comprising:

placing at least one fiber optic sensor proximate to the equipment, wherein the sensor comprises at least one coil of fiber optic cable having a length;

detecting acoustic emissions from the equipment by perturbing the length of the coil, the acoustic emissions from the equipment caused by mechanical operations of the equipment;

interferometrically interrogating the coil to produce a first data set indicative of the length of the coil as a function of time; and converting the first data set to a second data set indicative of a frequencies of the acoustic emissions, wherein the second data set is compared against a third data set indicative of properly functioning equipment.

27. The method of claim 26, wherein the coil is bounded by reflectors.

28. The method of claim 27, wherein the reflectors comprise fiber Bragg gratings.

29. The method of claim 26, wherein interrogating the coil comprises combination of light pulses reflected from the two reflectors.

30. The method of claim 26, wherein the sensor is affixed to the equipment.

31. The method of claim 26, wherein the sensor is separated from the equipment by a distance.

32. The method of claim 31, wherein the well comprises a production pipe, and wherein the sensor is coupled to the production pipe.

33. The method of claim 32, wherein the coil is coiled around the production pipe.

34. The method of claim 26, wherein the well comprises a casing, and wherein the sensor is coupled to the casing.

35. The method of claim 26, wherein the sensor comprises a compliant mandrel, and wherein the coil is coiled around the compliant mandrel.

36. The method of claim 26, wherein the sensor comprises a housing containing a mass moveable within the housing, and wherein the coil is coupled to the mass.

37. The method of claim 26, wherein the second data set is audibly broadcasted by a speaker.

38. The system of claim 1, wherein the equipment is a pump.

39. The system of claim 13, wherein the equipment is a pump.

40. The method of claim 26, wherein the equipment is a pump.

* * * * *